US007900274B2

(12) United States Patent
Chatman et al.

(10) Patent No.: US 7,900,274 B2
(45) Date of Patent: Mar. 8, 2011

(54) FUMBLE FLAPS

(76) Inventors: Jacob L. Chatman, Wayne, PA (US); Mario L. Chatman, Jacksonville, FL (US)

( * ) Notice: Subject to any disclaimer, the term of this patent is extended or adjusted under 35 U.S.C. 154(b) by 289 days.

(21) Appl. No.: 11/655,102

(22) Filed: Jan. 19, 2007

(65) Prior Publication Data

US 2008/0172773 A1 Jul. 24, 2008

(51) Int. Cl.
*A41D 13/00* (2006.01)

(52) U.S. Cl. ..... 2/69; 2/462; 2/463; 2/102; 473/438

(58) Field of Classification Search ..... 2/460, 462, 2/464, 77, 102, 267, 402, 463, 913; 473/215, 473/277, 422, 438, 450, 458, 464
See application file for complete search history.

(56) References Cited

U.S. PATENT DOCUMENTS 3,744,059 A * 7/1973 Hayes ..... 2/250
4,119,247 A * 10/1978 Newquist et al. ..... 224/191
4,413,762 A * 11/1983 Carini ..... 224/250
5,029,341 A * 7/1991 Wingo, Jr. ..... 2/462
5,978,961 A * 11/1999 Barker ..... 2/2.5
6,138,277 A * 10/2000 Gillen et al. ..... 2/102

* cited by examiner

*Primary Examiner* — Gary L Welch
*Assistant Examiner* — Alissa J Tompkins
(74) *Attorney, Agent, or Firm* — Amelia B. Yarbrough

(57) ABSTRACT

Fumble Flaps are disclosed which are cradles strategically located on a vest or shirt to prevent the fumbling of a ball by an offensive player.

1 Claim, 4 Drawing Sheets

FIG.1
FRONT
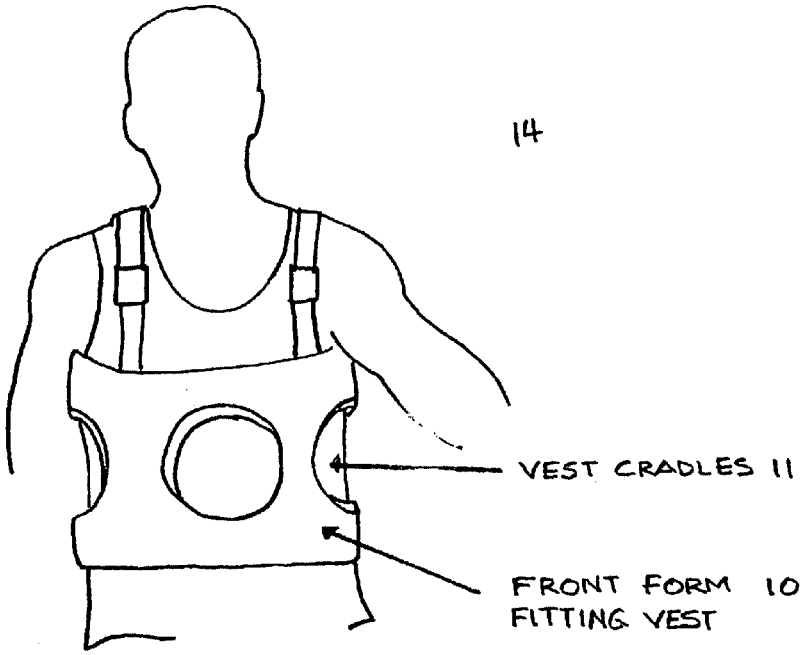
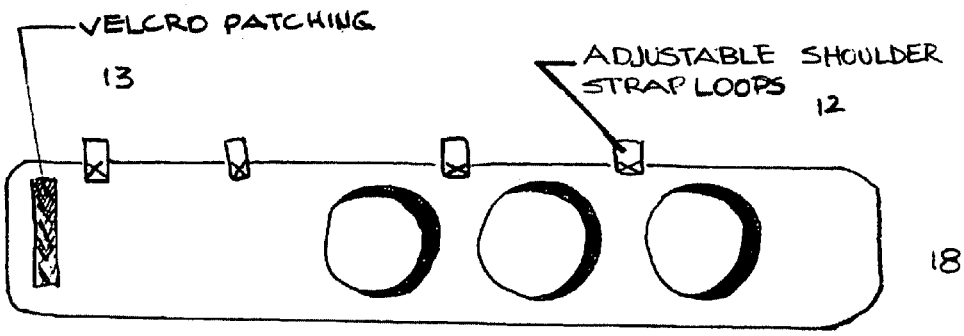
FIG.2
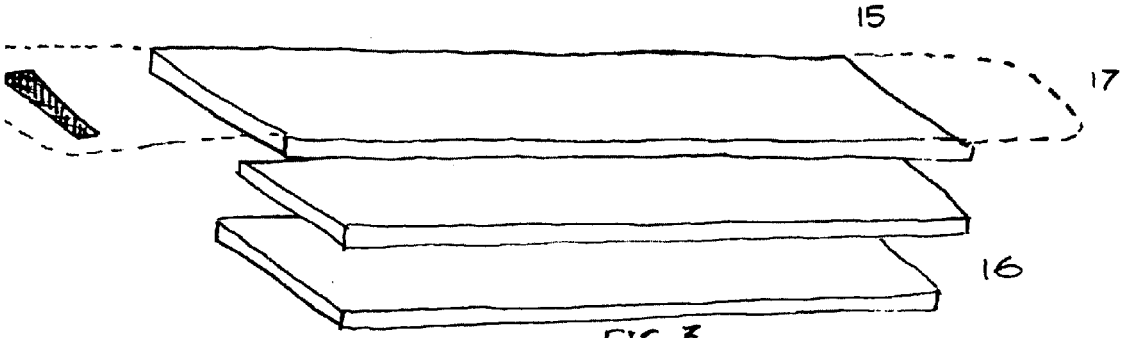
FIG.3

REAR

FUMBLE FLAPS

BACKGROUND AND SUMMARY

One of the obstacles in the game of football is fumbling the ball by an offensive Player. To reduce this problem, we have invented three pieces of equipment called Fumble Flap 1, 2 or 3.

This unique sports equipment is designed for football carriers so that they can obtain optimum control of the ball. Other uses include:

Training equipment for beginners in the Midget League to the N.F.L.

To teach ball carrying and rushing techniques.

To reduce fumbles during critical game situations.

When used for training purposes the player learns ball carrying and cover up techniques as well as developing a consciousness of ball protection. When worn and used properly in a game by a running back, it will help to cradle and protect the football and reduce the risk of fumbling.

BRIEF DESCRIPTION OF THE FIGURES

FIG. 1 shows the front view of the fumble flap vest.

FIG. 2 shows the vest fumble flap encasement.

FIG. 3 shows the padding and the cut-outs for the cradles.

DETAILED DESCRIPTION OF THE INVENTION

Figure 4:
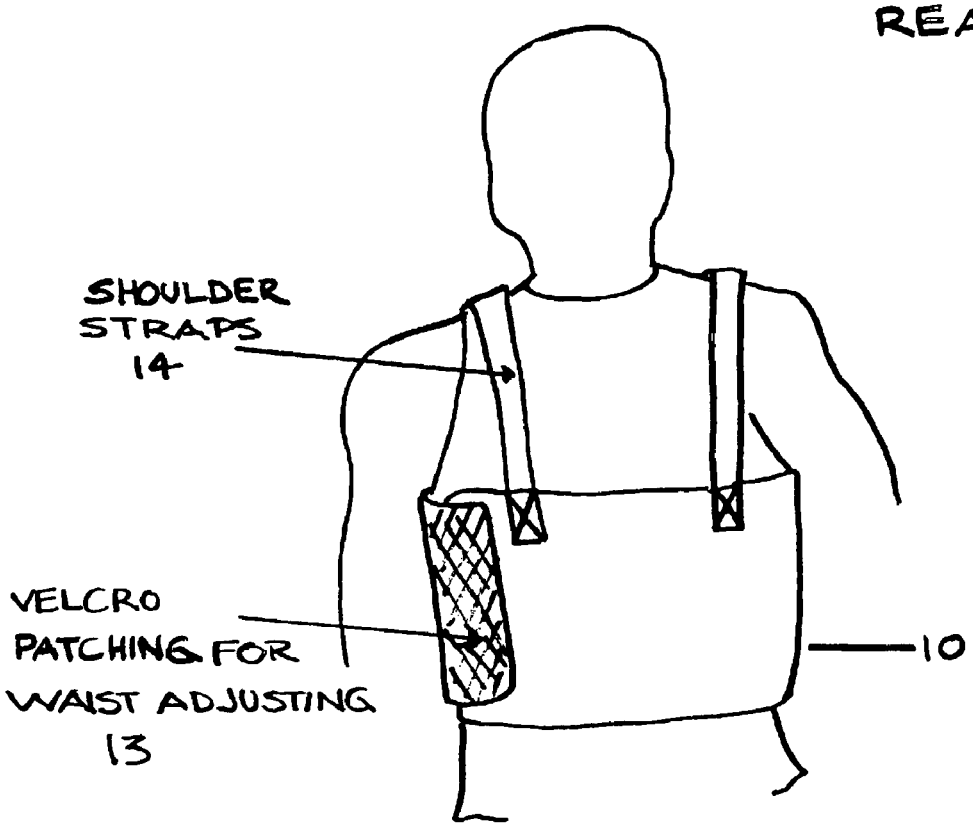
FIG. 4 shows the rear view of the vest fumble flap.
Figure 5:
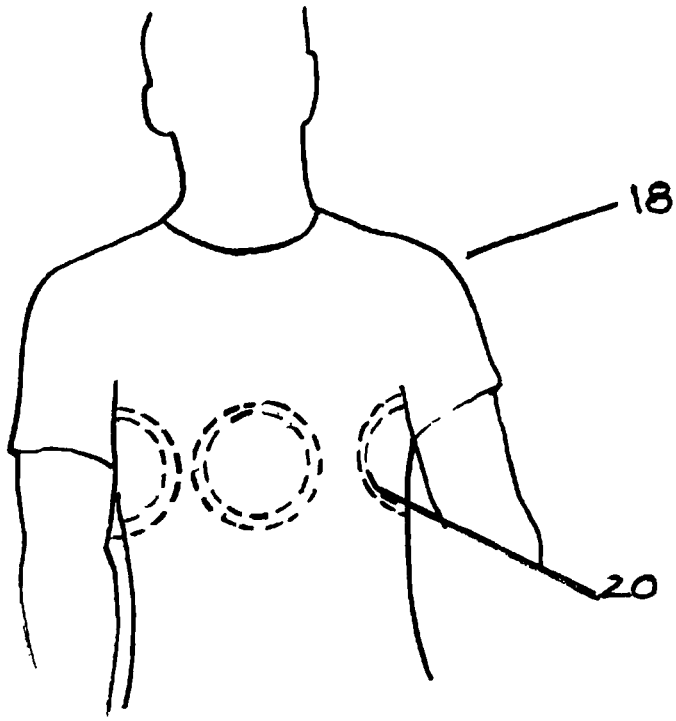
FIG. 5 shows the front view of a T-shirt design of the fumble flap.

Fumble Flap 1 (one) is an adjustable vest (10), designed with stationery cradles (11) strategically located so that the ball carrier can cradle the ball in his belly or on either side. The cradles are made with a corrugated front (15), having three 9 inch football shaped cut-outs that coincide with a one inch sponge rubber padding (17). This padding has three (3) cut-outs to match with the cut-outs in the corrugated front piece. These cut-outs are to accommodate the ball. This padding is backed with a solid ¼ inch rubber padding (16).

The flap is covered with an encasement made of cotton cloth with extended wrap-around tabs which wrap around the players' waist and fastens on the side with Velcro strips (13).

The two adjustable shoulder straps (14) provide opportunity for the player to adjust the fumble flap to a comfortable and affective position. FIG. 2 also shows loops for the adjustable shoulder straps.

The vest flap is worn under the player's jersey.

Figure 6:
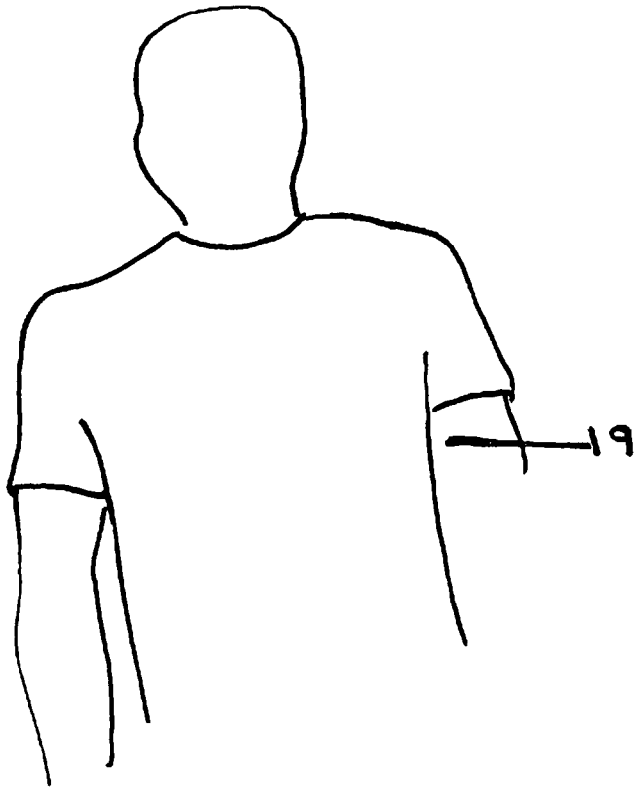
FIG. 6 shows the rear view of the T-shirt design of the fumble flap.
Figure 7:
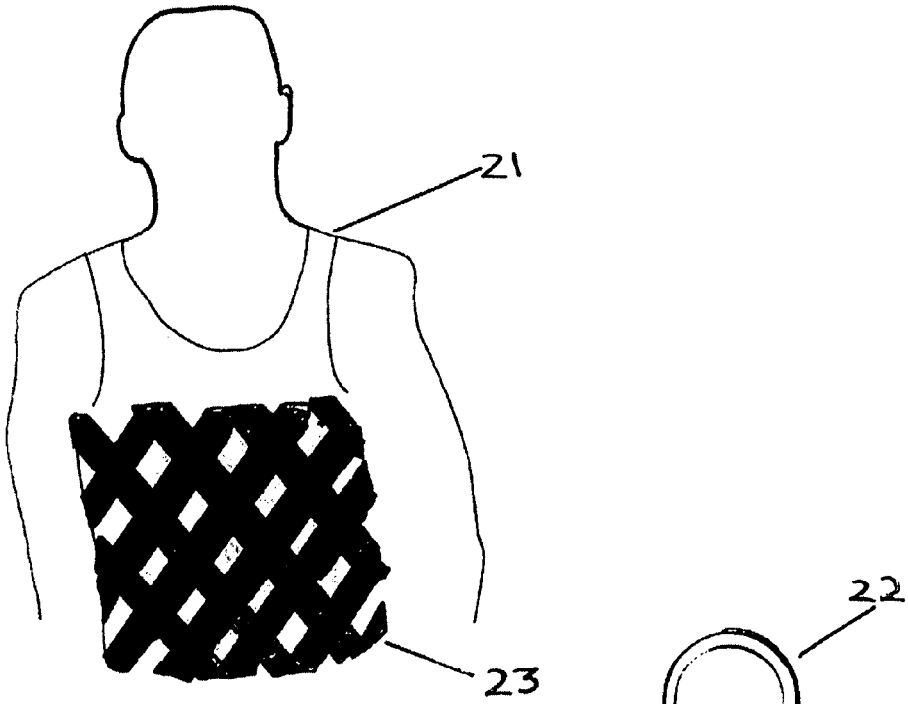
FIG. 7 shows a T-shirt design of the fumble flap with Velcro in the front.
Figure 8:
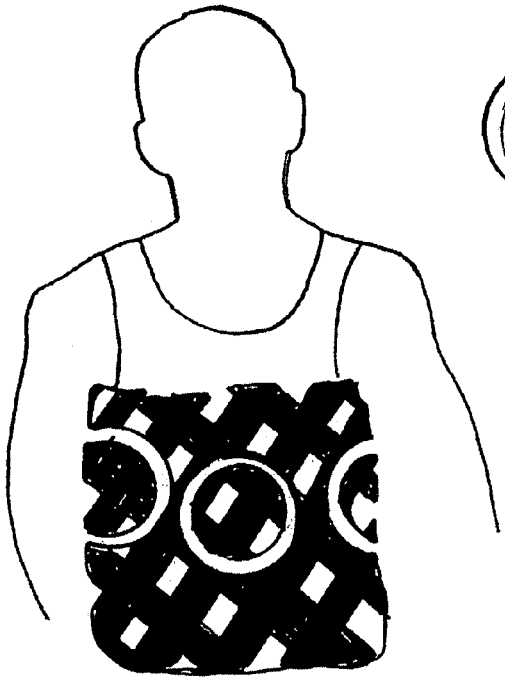
FIG. 8 shows the T-shirt with the cradles placed on the shirt.

Fumble flap 2 (two) is a slip-over T-shirt style (18) with three (3) cradles which are constructed in the fabric of the shirt. The cradles are made of rope rings with a thickness, size and curvature to accommodate the ball. The rings are located or prepositioned so that the ball carrier can carry the ball on his belly or on either side. The cradles are constructed from a one inch woven plastic rope which is durable, affective and less visible. This flap is tailored and fitted to the player's need and comfort and is always under the player's jersey. The rear view of the T-shirt is shown in FIG. 6.

Fumble flap 3 (three) consist of a T-shirt that is retrofitted with a lattice design of Velcro on the front and sides (23), and three individual 9 inch football shaped cradles (22) that are constructed from one inch plastic woven rope and padded with a Velcro backing. This allows the player to personally place the cradle on the front or side of the shirt to his/her own needs, function and comfort.

What is claimed is:

1. A Fumble Flap Vest worn on an upper torso of a wearer comprising a football receptacle having, a rectangular corrugated front panel having three 9-inch circular football shaped cradles;

a 1 inch thick rectangular sponge rubber padding having three 9-inch circular football shaped cut-outs coinciding with said cradles affixed to said front panel;

a ¼ inch thick solid rectangular rubber padding affixed to said sponge rubber padding;

said receptacle enclosed by a rectangular cotton cloth having complementary hook and loop fasteners at each end for securing and wrapping around the upper torso;

said receptacle having a pair of adjustable shoulder straps having complementary hook and loop fasteners to allow the vest to be secured on the wearer's upper torso.

* * * * *